US009185773B2

(12) United States Patent
Yotsumoto et al.

(10) Patent No.: US 9,185,773 B2
(45) Date of Patent: Nov. 10, 2015

(54) ELECTRIC LIGHT BULB TYPE LIGHT SOURCE APPARATUS

(71) Applicant: Sony Corporation, Tokyo (JP)

(72) Inventors: Naoki Yotsumoto, Tokyo (JP); Kouji Miyata, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 329 days.

(21) Appl. No.: 13/717,962

(22) Filed: Dec. 18, 2012

(65) Prior Publication Data

US 2013/0181607 A1 Jul. 18, 2013

(51) Int. Cl.
*H05B 37/00* (2006.01)
*H05B 37/02* (2006.01)
(Continued)

(52) U.S. Cl.
CPC ..... *H05B 37/00* (2013.01); *F21K 9/1355* (2013.01); *F21V 3/02* (2013.01); *F21V 33/0052* (2013.01); *H05B 37/0272* (2013.01); *F21V 3/0418* (2013.01); *F21V 3/0436* (2013.01); *F21V 19/0055* (2013.01); *F21V 23/0442* (2013.01); *F21V 23/0478* (2013.01); *F21V 29/506* (2015.01); *F21V 29/86* (2015.01);
(Continued)

(58) Field of Classification Search
CPC ..... F21K 9/00; F21K 9/13; F21K 9/135; F21K 9/1355; F21V 23/02; F21V 23/0471; F21V 33/0052; F21V 33/0056; F21V 19/00; F21V 19/0055; F21V 23/00; F21V 23/0442; F21V 23/0478; F21V 29/00; F21V 29/89; F21V 29/87; F21V 29/86; F21V 29/506; F21V 3/00; F21V 3/02; F21V 3/0418; F21V 3/0436; F21V 33/00; H05B 33/08; H05B 33/0803; H05B 33/0815; H05B 37/00; H05B 37/0272; F21Y 2101/00; F21Y 2101/02
USPC ..... 315/70
See application file for complete search history.

(56) References Cited

U.S. PATENT DOCUMENTS

2010/0141153 A1* 6/2010 Recker et al. ..... 315/149
2015/0028740 A1* 1/2015 Yotsumoto et al. ..... 315/70

FOREIGN PATENT DOCUMENTS

JP 2009-141924 6/2009
JP 2010-56059 3/2010
JP 2010-257718 11/2010

OTHER PUBLICATIONS

U.S. Appl. No. 14/383,168, filed Jun. 2014, Yotsumoto et al.*
(Continued)

*Primary Examiner* — Lincoln Donovan
*Assistant Examiner* — David Mattison
(74) *Attorney, Agent, or Firm* — Hazuki International, LLC

(57) ABSTRACT

An electric light bulb type light source apparatus includes a base, an insulated power source circuit, a light source unit, a light source drive circuit, a speaker, a speaker drive circuit, a plurality of substrates, and a casing. The insulated power source circuit has a transformer that insulates a primary side circuit from a secondary side circuit, converts a voltage to a first DC power source voltage, and outputs the first DC power source voltage. The light source drive circuit drives the light source unit by using the first DC power source voltage output from the power source circuit. The speaker drive circuit drives the speaker by using the first DC power source voltage output from the power source circuit. On the plurality of substrates, the power source circuit, the light source drive circuit, and the speaker drive circuit are mounted. The casing contains the plurality of substrates.

7 Claims, 6 Drawing Sheets

(51) Int. Cl.

| | |
|---|---|
| ***F21V 33/00*** | (2006.01) |
| ***F21K 99/00*** | (2010.01) |
| ***F21V 3/02*** | (2006.01) |
| *F21V 3/04* | (2006.01) |
| *F21V 19/00* | (2006.01) |
| *F21V 23/04* | (2006.01) |
| *F21Y 101/02* | (2006.01) |
| *F21V 29/506* | (2015.01) |
| *F21V 29/85* | (2015.01) |
| *F21V 29/87* | (2015.01) |
| *F21V 29/89* | (2015.01) |

(52) U.S. Cl.
CPC ..... *F21V 29/87* (2015.01); *F21V 29/89* (2015.01); *F21Y 2101/02* (2013.01)

(56) References Cited

OTHER PUBLICATIONS

U.S. Appl. No. 14/363,939, filed Jun. 9, 2014, Yotsumoto, et al.
U.S. Appl. No. 14/363,168, filed Jun. 5, 2014, Yotsumoto, et al.
U.S. Appl. No. 13/687,246, filed Nov. 28, 2012, Yotsumoto, et al.

* cited by examiner

ELECTRIC LIGHT BULB TYPE LIGHT SOURCE APPARATUS

BACKGROUND

The present disclosure relates to an electric light bulb type light source apparatus.

As an electric light bulb type lighting apparatus, Japanese Patent Application Laid-open No. 2008-193189 (hereinafter, referred to as Patent Document 1) discloses a lighting apparatus equipped with a speaker. The lighting apparatus is provided with a cylindrical casing, a speaker provided on the center of a front surface of the casing, and a plurality of LED (light emitting diode) elements disposed around the speaker on the front surface of the casing. The lighting apparatus is further provided with a power supply circuit including an AC/DC converter, a transformer, and the like (see, for example, paragraph 0022 in the specification of Patent Document 1).

SUMMARY

To use the lighting apparatus disclosed in Patent Document 1 as an electrical light bulb type apparatus in actuality, it is necessary to downsize the apparatus. In particular, it is demanded to downsize a power source circuit as much as possible because the sizes of electrical components such as the transformer included in the power source circuit are relatively large.

In view of the above-mentioned circumstances, it is desirable to provide an electric light bulb type light source apparatus capable of achieving the downsizing the entire apparatus by downsizing the power source circuit.

According to an embodiment of the present disclosure, there is provided an electric light bulb type light source apparatus including a base, a power source circuit, a light source unit, a light source drive circuit, a speaker, a speaker drive circuit, a plurality of substrates, and a casing.

The power source circuit has a transformer that insulates a primary side circuit and a secondary side circuit from each other and is configured to convert a voltage supplied via the base to a first DC power source voltage and output the first DC power source voltage.

The light source drive circuit is configured to drive the light source unit by using the first DC power source voltage output from the power source circuit.

The speaker drive circuit is configured to drive the speaker by using the first DC power source voltage output from the power source circuit.

On the plurality of substrates, the power source circuit, the light source drive circuit, and the speaker drive circuit are mounted.

The casing is configured to contain the plurality of substrates.

The insulated power source circuit according to the embodiment of the present disclosure outputs a power source voltage generated by one transformer, and the light source drive circuit and the speaker drive circuit generate voltages different from each other from the power source voltage generated. That is, it is not necessary to provide a plurality of transformers, which can downsize the power source circuit and the power source substrate. As a result, it is possible to achieve the downsizing of the electric light bulb type light source apparatus.

The light source drive circuit may be a constant current circuit and may drive the light source unit with electric power having a second voltage higher than the first DC power source voltage output from the power source circuit.

The electric light bulb type light source apparatus may further include a voltage conversion circuit configured to convert the first DC power source voltage output from the power source circuit and output a third DC power source voltage and a control circuit configured to receive an external signal transmitted from an external apparatus and output a control signal in accordance with the external signal received to the drive circuits. The control circuit is capable of being driven by using the third DC power source voltage. With this structure, the control circuit can perform control with electric power having the third DC power source voltage sufficient for the control circuit.

The first DC power source voltage may be higher than the third DC power source voltage. Thus, the first DC power source voltage is set to be lower than the second voltage and set to be higher than the third DC power source voltage, thereby making it possible to suppress the power loss.

One of the plurality of substrates may be a control substrate on which the control circuit is mounted.

The plurality of substrates may include a power source substrate on which the power source circuit is mounted and a drive substrate on which both the light source drive circuit and the speaker drive circuit are mounted. In this case, the power source substrate includes a first surface opposed to the base and a second surface provided on a side opposite to the first surface and opposed to the light source unit. Further, the power source circuit has a transformer including a primary side coil and a secondary side coil and a primary side electronic component electrically connected to the primary side coil, and the transformer and the primary side electronic component are mounted on the first surface of the power source substrate. The insulating transformer and the primary side electronic component of the power source circuit are relatively large electronic components. On the first surface, which is the base side of the power source substrate, those components are disposed, and in the space on the second surface side, the light source unit is disposed, with the result that a small space can be effectively used.

As described above, according to the embodiments of the present disclosure, it is possible to downsize the entire electric light bulb type light source apparatus by downsizing the power source circuit.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, an embodiment of the present disclosure will be described with reference to the drawings.

(Overall Structure of Electric Light Bulb Type Light Source Apparatus)

Figure 1:
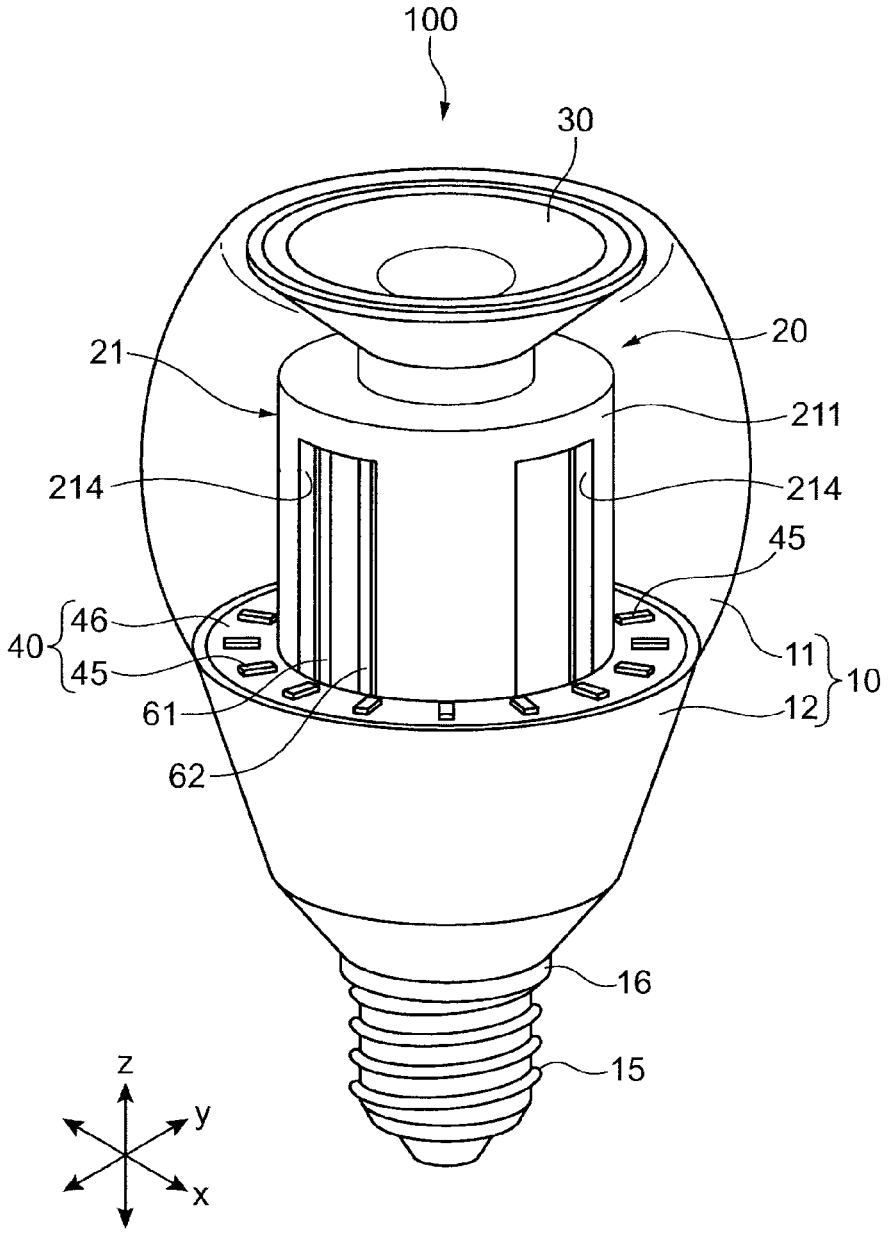
FIG. 1 is a perspective view showing an electric light bulb type light source apparatus according to an embodiment of the present disclosure.
Figure 2:
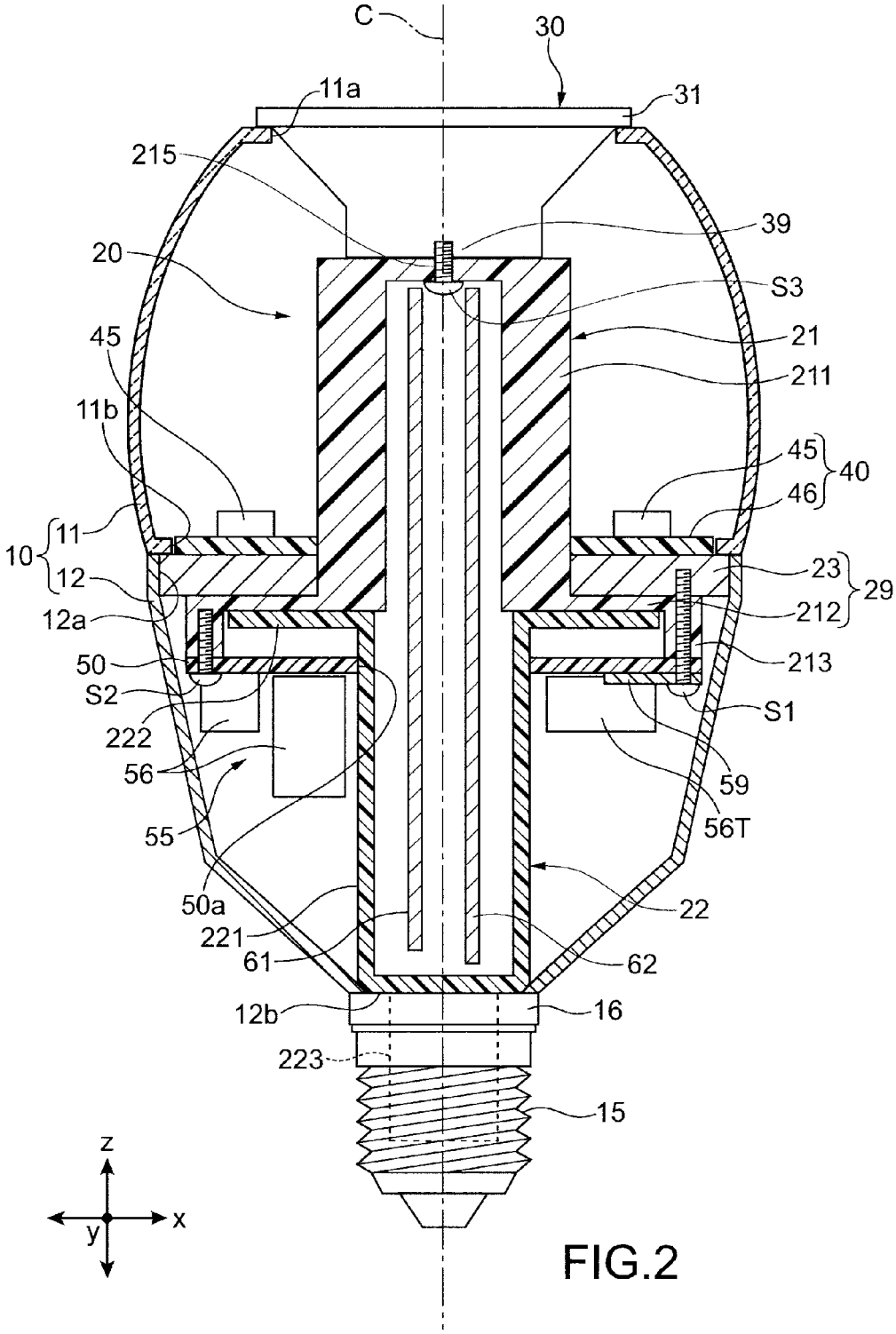
FIG. 2 is a schematic cross-sectional view showing the electric light bulb type light source apparatus shown in FIG. 1.

FIG. 1 is a perspective view showing an electric light bulb type light source apparatus 100 according to an embodiment of the present disclosure. FIG. 2 is a schematic cross-sectional view showing the electric light bulb type light source apparatus 100 shown in FIG. 1. In the following description, the electric light bulb type light source apparatus is simply referred to as a light source apparatus.

The light source apparatus 100 is provided with a casing 10, a light source unit 40 disposed in the casing 10, a speaker 30 provided on one end portion of the casing 10, and a base 15 connected to the other end portion (opposite side to the position of the speaker 30) of the casing 10 with an electrically insulating ring 16 disposed therebetween.

For convenience of explanation, in the following, it is assumed that a direction along a z axis in FIGS. 1 and 2 is a back-and-forth direction of the light source apparatus 100, and specifically, the speaker 30 side corresponds to a front side, and the base 15 side corresponds to a rear side.

The casing 10 has, for example, a base casing 12 and a translucent cover 11 which is attached to the base casing 12. As shown in FIG. 2, the translucent cover 11 has a first opening portion 11*a* formed on an end portion on the front side and a second opening portion 11*b* formed on the opposite side thereto along the z axis direction. The speaker 30 is attached to the translucent cover 11 so as to block the first opening portion 11*a*. On the side of the second opening portion 11*b* of the translucent cover 11, the base casing 12 is provided. The translucent cover 11 is made of glass, acrylic, polycarbonate, or the like.

The light source apparatus 100 is provided with a support unit 20 that supports the speaker 30. The support unit 20 integrally supports the light source unit 40, the speaker 30, and the base 15 so that the speaker 30 and the light source unit 40 is separated from each other, and the light source unit 40 is disposed between the speaker 30 and the base 15. As shown in FIG. 2, typically, the support unit 20 has a heat sink 23, a holding member 21 that is fixed to the heat sink 23 and holds the speaker 30, and a substrate containing box 22 that is disposed so as to be opposed to the holding member 21.

The heat sink 23 of the support unit 20 functions as a chassis of the light source apparatus 100. The heat sink 23 is disposed around a center axis C (see FIG. 2), which is an axis that passes through the center of the speaker 30 along a vibration direction (z axis direction) of a diaphragm 35 (see FIG. 3) included in the speaker 30. The area indicated by the term "around the axis" includes the entire circumference of the axis and a part thereof. Typically, the heat sink 23 has a plate shape and is formed around the entire circumference of the center axis C, that is, formed into a ring shape.

The light source unit 40 is also disposed around the center axis C like the heat sink 23 and is typically formed into a ring shape and disposed on the heat sink 23. For example, the light source unit 40 has a ring-shaped mounting substrate 46 and a plurality of LED (light emitting diode) elements 45 arranged in a ring form on the mounting substrate 46. For one LED element 45, an element that generates white light is used, but an element that generates light of a single color other than white or a plurality of colors may be used.

The heat sink 23 is mainly made of aluminum, for example. However, the heat sink 23 may be made of another metal material such as copper, as long as the material has thermal conductivity, or may be made of ceramics or resin having a high heat radiation property.

The base 15 is formed so as to be mountable on a socket of a general incandescent light bulb. The base 15 is a member that supplies power to a circuit substrate on which various circuits are mounted, the light source unit 40, and the speaker 30 via a power source circuit 55 to be described later.

The length of the light source apparatus 100 in the z axis direction is 100 to 120 mm, typically about 110 mm. The diameter of the light source apparatus 100 viewed in the z axis direction is 50 to 70 mm, typically about 60 mm.

(Specific Structure of Speaker)

Figure 3:
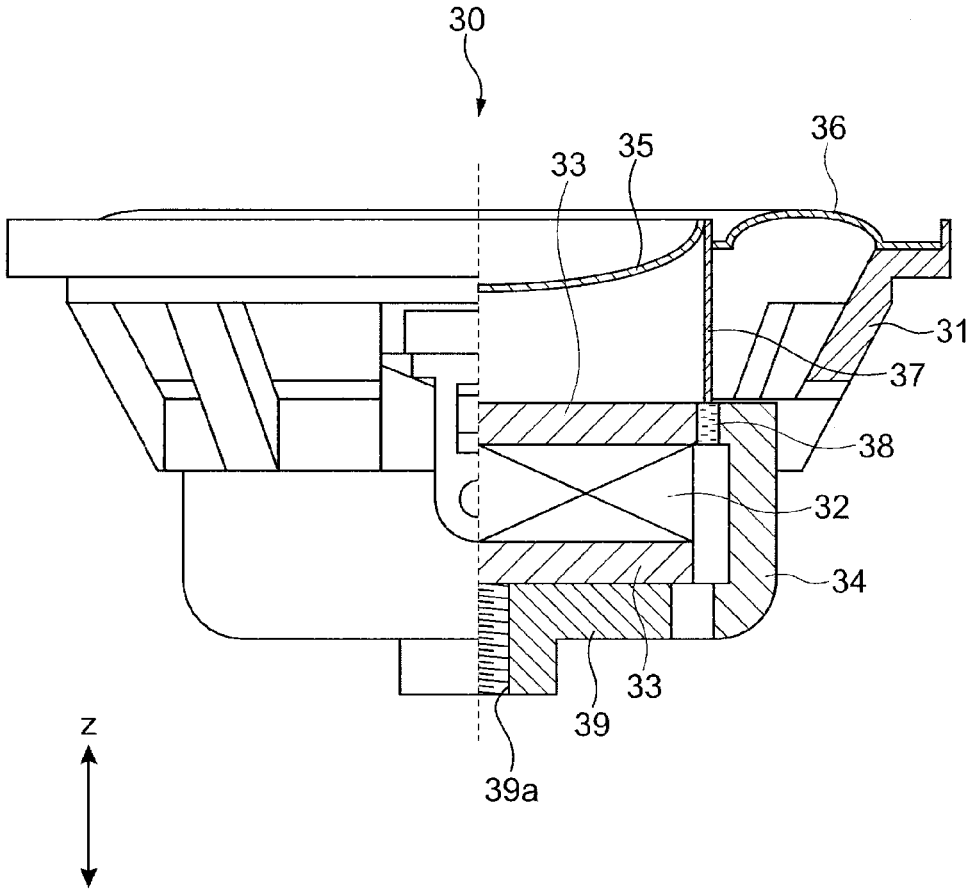
FIG. 3 is a cross-sectional view showing a speaker according to the embodiment.

FIG. 3 is a cross-sectional view showing the speaker 30 according to the embodiment. The speaker 30 is a dynamic type damperless speaker. The speaker 30 is provided with a frame 31, a permanent magnet 32, a plate 33, a yoke 34, the diaphragm 35, an edge 36, a coil bobbin 37, a magnetic fluid 38, and an attachment bottom portion 39.

Instead of a damper in related art, the magnetic fluid 38 is provided in a magnetic gap between the yoke 34 and the plate 33 on the upper side thereof. Further, in the magnetic gap, a voice coil (not shown) is provided. On the attachment bottom portion 39, a threaded hole 39*a* is formed. As will be described later, through the threaded hole 39*a*, the speaker 30 is attached to the holding member 21 of the support unit 20 with a screw S3 (see FIG. 2).

As will be described later, in this embodiment, because the speaker 30 and the light source unit 40 are disposed separately from each other, the speaker 30 is unlikely to be affected by heat of the light source unit 40. Therefore, as the permanent magnet 32 used for the speaker 30, a permanent magnet having a relatively low heat resistance, that is, relatively low demagnetization temperature can be used. For example, a permanent magnet having the demagnetization temperature of 60° C. to 100° C. (inclusive) can be used. As the permanent magnet having the demagnetization temperature of 100° C. or less, neodymium can be used, for example.

The magnetic force of a neodymium magnet is higher than that of a ferrite core magnet or the like, and the demagnetization temperature of the neodymium is about 80° C., which is lower than that of ferrite. In the case where the ferrite core magnet is applied to the speaker 30 of the light source apparatus 100 according to this embodiment, to obtain a magnetic force equivalent to the magnetic force of the neodymium magnet, the size of the ferrite core magnet has to be increased, which is not suitable for the downsizing of the light source apparatus 100. It is also thought that a heat generation quantity of the light source unit 40 is reduced so as not to demagnetize the permanent magnet, but this means that input power to the light source apparatus 100 is suppressed, which reduces a light flux quantity.

In view of the above, in this embodiment, neodymium having a lower heat resistance and a larger magnetic force than ferrite is used, and the speaker 30 and the light source unit 40 is disposed so as to be separated from each other, with the result that the above problem is overcome.

For example, at least a part of the frame 31 of the speaker 30 and at least a part of the edge 36 may be made of a translucent material. As the translucent material, a known material such as an acrylic-based resin material, a polyvinyl-based resin material, and a polyimide-based resin material is used. Thus, light emitted from the light source unit 40 passes through a part of the speaker 30, with the result that it is possible to increase light distribution characteristics leaning to the center of the light source apparatus 100.

(Specific Structure of Support Unit)

Figure 4:
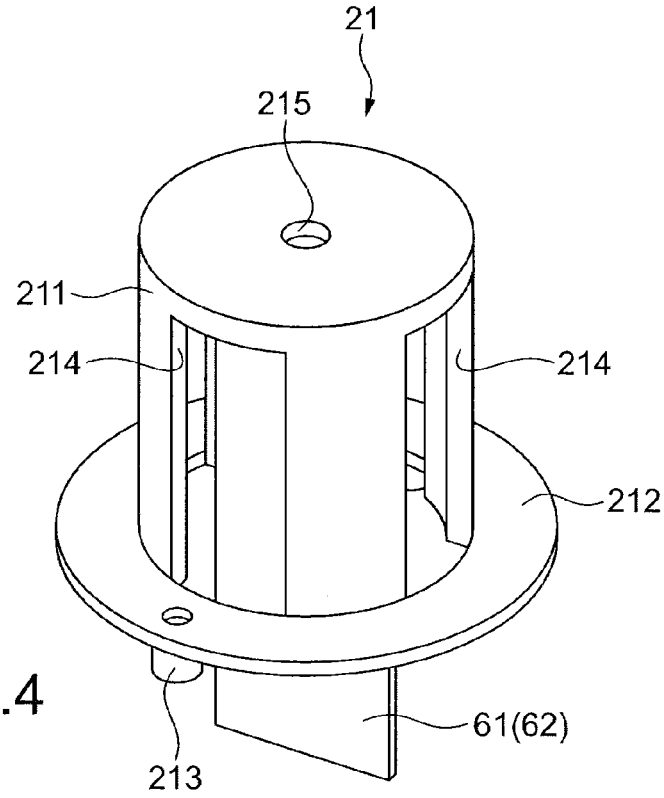
FIG. 4 is a perspective view showing a holding member of a support unit.

FIG. 4 is a perspective view showing the holding member 21 of the support unit 20. The holding member 21 has a tubular portion 211 to which the speaker 30 is attached and a flange portion 212 provided on an end portion on the rear side of the tubular portion 211. The holding portion 21 is disposed in the casing 10 so that the tubular portion 211 passes through the center hole of the heat sink 23 and the light source unit 40, and a longitudinal direction of the tubular portion 211 is extended along the z axis direction.

On an end surface on the front side of the tubular portion 211, a threaded hole 215 is formed. In the threaded hole 215 and the threaded hole 39*a* which is formed in the speaker 30, the screw S3 (see FIG. 2) is screwed. With this structure, the speaker 30 is held by the holding member 21. The way of attaching the speaker 30 to the holding member 21 is not limited to the screwing, and bonding with an adhesive or engagement with an uneven member may be used.

As shown in FIG. 2, the holding member 21 is attached to the heat sink 23 with a screw S1. Specifically, on the flange portion 212 of the holding member 21, an attachment portion 213 for screwing is formed so as to be projected toward the rear side. The heat sink 23 is placed on the flange portion 212, and the holding member 21 is attached to the heat sink 23 through the attachment portion 213 from the back surface side (rear side) of the heat sink 23.

With the structure of the holding member 21 and the heat sink 23 as described above, because the light source unit 40 is disposed separately from the speaker 30 to the rear side thereof as described above, it is possible to suppress the heat influence from the light source unit 40 with respect to the speaker 30. As a result, it is possible to desirably maintain the function of the speaker 30. For example, in the case where the heat influence to the speaker 30 is large, there is a problem in that the demagnetization of the permanent magnet 32 provided to the speaker 30 may occur, but by the light source apparatus 100 according to this embodiment, it is possible to overcome such a problem.

Further, the speaker 30 is disposed on the side from which light of the light source unit 40 is emitted, that is, on a position where the emitted light is shielded. The light source unit 40 is provided in a ring-shaped form, thereby increasing a light distribution angle. Furthermore, the light source unit 40 can emit light with the light distribution as a uniform light quantity with respect to the center axis C.

In this embodiment, the holding member 21 that holds the speaker 30 is disposed so as to be surrounded by the light source unit 40. Therefore, it is possible to reduce the disposition space of the holding member 21 and the light source unit 40 in the electric light bulb type light source apparatus 100, that is, it is possible to increase the disposition density of these members, which can achieve the downsizing of the light source apparatus 100 while ensuring a desired light distribution angle.

To the tubular portion 211 of the holding member 21, a reflection portion that reflects light emitted from the light source unit 40 may be provided. The reflection portion is a part formed of a mirror surface or a material having color with a high light reflectance, for example. The color with the high reflectance refers to white, milky while, or color close to those, for example. Of course, the holding member 21 itself may be formed of a white or milky while resin material. As the resin material, ABS (acrylonitrile butadiene styrene), PBT (polybutylene terephthalate), or the like is used, but another material may be used therefor.

In addition, in the case where the reflection portion is formed of a white or milky white material, for example, the reflection portion can diffusely reflect (scatter) light. Alternatively, when the reflection portion has a reflection surface that is subjected to a blast process, the reflection surface also can diffusely reflect light.

As described above, by providing the reflection portion, it is possible to increase the light distribution angle of light emitted from the light source unit 40 and effectively use light from the light source unit 40, which can increase the illuminance.

Figure 5:
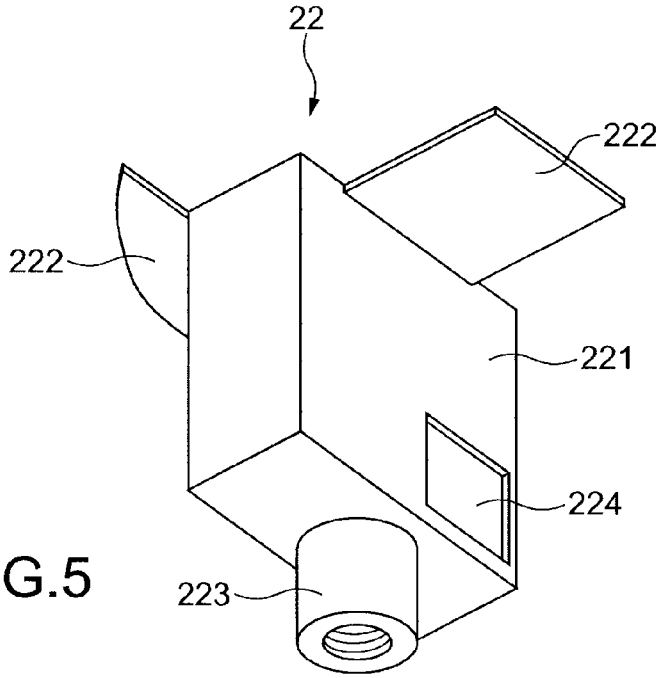
FIG. 5 is a perspective view showing a substrate containing box of the support unit viewed from below.

FIG. 5 is a perspective view showing the substrate containing box 22 of the support unit 20 viewed from below. The substrate containing box 22 has a main body 221, a plurality of contact plates 222, and a projection portion 223. The contact plates 222 are projected in a direction perpendicular to the z axis from the main body 221, and the projection portion 223 is projected in the z axis direction from the main body 221. In FIG. 5, the plurality of contact plates 222 having different shapes are provided, but only one contact plate 222 may be provided.

Further, in the main body 221, a connection hole portion 224 to which a connector for conduction (not shown) is connected is formed. A plurality of connection hole portions 224 may be formed.

As shown in FIG. 2, the main body 221 is uprightly provided along the z axis direction, and the holding member 21 and the substrate containing box 22 are disposed in the casing 10 so as to be opposed to each other so that the contact plates 222 are in contact with the flange portion 212 of the holding member 21. In an area formed in the holding member 21 and the substrate containing box 22 disposed as described above, that is, in an area in the tubular portion 211 and the main body 221, the circuit substrates are disposed. A plurality of, e.g., two circuit substrates are provided (drive substrate 61 and control substrate 62). As will be described later, the drive substrate 61 is provided as a common substrate on which an LED drive circuit 614 and an audio amplifier (AMP) 613 (see FIG. 7) to be described later are mounted.

The projection portion 223 is disposed in the base 15 so as to be inserted in an opening end portion 12*b* on the rear side of the base casing 12, as shown in FIG. 2. The projection portion 223 is formed in a tubular form and disposed so that a lead (not shown) that connects a terminal of a top portion of the base 15 and a power source substrate 50 to be described later with each other passes through the inside of the projection portion 223.

Like the holding member 21, the substrate containing box 22 is formed of a nonconductive material, for example, an ABS resin material mainly. In this way, a desirable material as an electrically insulating material and a fire-retardant material is used for the holding member 21 and the substrate containing box 22.

In the tubular portion 211 of the holding member 21, a plurality of openings 214 are formed. As a result, in the casing 10, via the openings 214, an external area of the tubular portion 211 of the holding member 21 is communicated with an area in the tubular portion 211 and the substrate containing box 22. With this structure, in the casing 10, it is possible to use not only the external area of the tubular portion 211 but also the area in the tubular portion 211 and the substrate containing box 22 as an enclosure of the speaker 30. As a result, the volume of the enclosure becomes larger, which improves the sound quality of the speaker 30. It should be noted that only one opening 214 may be formed in the tubular portion 211.

The base casing 12 is formed of a material having relatively high thermal conductivity, for example, mainly aluminum. As a material of the base casing 12, any other metal material such as copper may be used as long as the material has high thermal conductivity. Alternatively, a material of the base casing 12 may be resin having a high heat radiation property or ceramics. The heat sink 23 and the base casing 12 are thermally connected with each other. As shown in FIG. 2, for example, an opening end portion 12*a* formed on the base casing 12 and a side surface of the heat sink 23 are in contact with each other directly or through a heat conductive sheet or the like, thereby causing heat conduction between the members. As a result, heat generated from the light source unit 40 is efficiently radiated to the outside via the heat sink 23 and the base casing 12.

It should be noted that the heat sink 23 and the base casing 12 may be formed of different main materials.

With reference to FIG. 2, the translucent cover 11 is disposed with respect to the base casing 12 so that an opening surface of the opening end portion 12*a* of the base casing 12 and an opening surface of the second opening portion 11*b* of the translucent cover 11 face each other. The support unit 20 supports the speaker 30 so that the translucent cover 11 is pressed against the heat sink 23 with the speaker 30, and the speaker 30 and the support unit 20 sandwich the translucent cover 11.

The heat sink 23 mainly forms a base portion 29 of the support unit 20. The base portion 29 of the support unit 20 includes the flange portion 212 of the holding member 21. Further, the base portion 29 of the support unit 20 may include the base casing 12.

As described above, the speaker 30 supported by the support unit 20 sandwiches the translucent cover 11 with the heat sink 23 and supports the translucent cover 11 with the translucent cover 11 pressed against the heat sink 23. Thus, it is not necessary to directly fix the translucent cover 11 to the heat sink 23 and the speaker 30. Therefore, even if the translucent cover 11 having a thermal expansion coefficient different from the thermal expansion coefficients of the heat sink 23 and (the frame 31 of) the speaker 30 is thermally expanded due to a temperature change of the light source unit 40, deformation due to the thermal expansion at the opening portions 11*a* and 11*b* that face the speaker 30 and the heat sink 23, respectively, is tolerated, and it is possible to let a stress of the thermal expansion get away. Thus, it is possible to suppress such an accident that a mechanical stress is generated in the translucent cover 11, and the translucent cover 11 deteriorates.

(Structures of Various Circuit Substrates)

As shown in FIG. 2, in the base casing 12, the power source substrate 50 on which the power source circuit 55 is mounted is contained. The power source substrate 50 is attached to the holding member 21 with a screw S2. Further, with the screw S1 that connects the holding member 21 and the heat sink 23 with each other, the power source substrate 50 is also attached to the heat sink 23.

Here, in general, in the viewpoint of suitability of an LED light bulb to a lighting apparatus, the shape of the LED light bulb is desired to be close to the shape of an incandescent light bulb, and the LED light bulb is desired to be downsized as much as possible. If a product size of the LED light bulb is significantly large, the quality of the product is degraded. In the case where the power source substrate and a drive circuit substrate of the LED are disposed on the same plane or disposed along a parallel plane, the product size is increased, and an outer circumferential size of a casing in the vicinity of a base is also increased. In the viewpoint of the suitability to a lighting apparatus, it is ideal to achieve an LED light bulb having the outer circumferential size of the casing in the vicinity of the base which is close to that of the incandescent light bulb. Therefore, in such a viewpoint, a product in which the power supply substrate and another circuit substrate are disposed on the same plane as described above leads to the degradation of the quality of the product. In view of this, in the present disclosure, the circuit substrates are disposed as follows.

Figure 6:
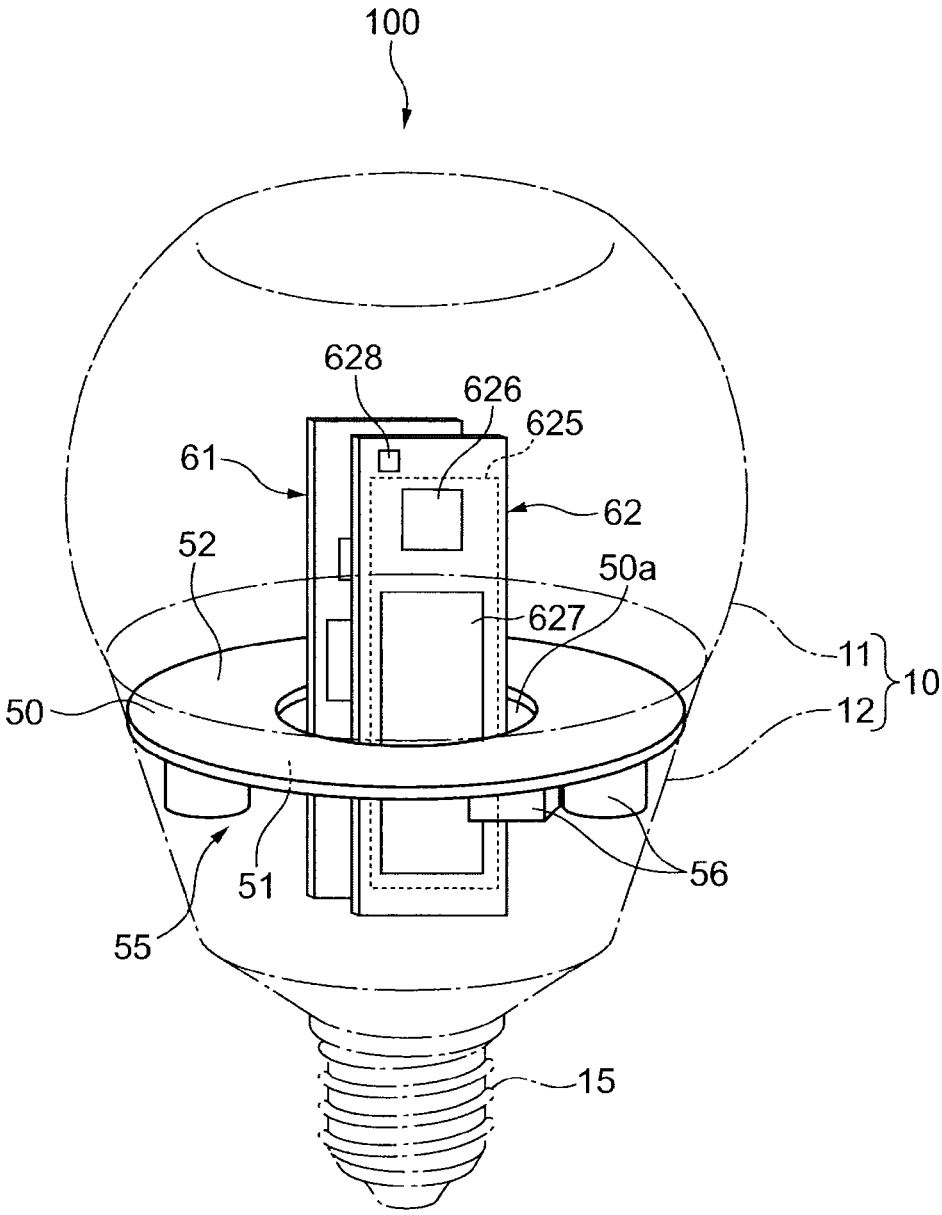
FIG. 6 is a diagram showing a disposition relationship between a power source substrate and other substrates (drive substrate and control substrate)

FIG. 6 is a diagram showing a disposition relationship between the power source substrate 50 and other substrates (drive substrate 61 and control substrate 62 as described above). The power source substrate 50 has a void area 50*a*, and the drive substrate 61 and the control substrate 62 are partly disposed in the void area 50*a*.

Typically, the void area 50*a* is formed of a through hole, that is, the power source substrate 50 is formed into a ring shape. Specifically, as shown in FIG. 2, in the void area 50*a*, the main body 221 of the substrate containing box 22 is inserted. As a result, the drive substrate 61 and the control substrate 62 disposed in the holding member 21 and the substrate containing box 22 are disposed so as to perpendicularly cross the power source substrate 50 through the through hole of the power source circuit 55. In this way, the drive substrate 61 and the control substrate 62 are integrally supported by the support unit 20 with the light source unit 40 and the like.

As described above, the drive substrate 61 and the control substrate 62 are disposed so as to be inserted in the through hole of the power source substrate 50, so it is possible to efficiently dispose components in the small containing space of the casing 10 and achieve the downsizing of the light source apparatus 100.

Specifically, an envelope shape of the entire substrates disposed as described above approaches the shape obtained by disposing two schematic triangular shapes oppositely to each other along the z axis direction. The shape approaches an outline of the casing 10 in which the base casing 12 and the translucent cover 11 are fitted when the light source apparatus 100 is viewed from the side. That is, by disposing the substrates 50, 61, and 62 as described above, it is possible to increase the density of the components in the casing 10, which can downsize the light source apparatus 100.

Further, it is possible to densely dispose the substrates 50, 61, and 62 in the casing 10, so the volume of the speaker 30 as the enclosure can be sufficiently ensured, which can improve the sound quality of the speaker 30.

As shown in FIG. 6, on the control substrate 62, a receiving unit (or light receiving unit) 628, an antenna 626, and a network control circuit 627 are mounted.

The receiving unit 628 receives an infrared signal transmitted from a remote controller (not shown) which can be used by a user. The position and posture of the control substrate 62 are set so that the receiving unit 628 is disposed on a position where the infrared signal can be received, that is, disposed in an area (area on the front side of the light source unit 40) in the translucent cover 11 in the casing 10. For example, the receiving unit 628 is mounted on an end portion on the front side of the control substrate 62. The remote controller (not shown) is an apparatus that generates signals for turning-on and -off, dimming, and toning of the light source unit 40, and the like.

Typically, the antenna 626 is an antenna for near field communication such as Bluetooth. Further, the network control circuit 627 is compliant with the communication standard. The position and posture of the drive substrate 61 are set so that the antenna 626 is disposed on a position where a radio signal can be received, that is, disposed in an area (area on the front side of the light source unit 40) in the translucent cover 11 in the casing 10. For example, an AV (audio video) apparatus serving as an apparatus to be operated by the user transmits a radio signal, and the antenna 626 receives the radio signal. For example, the signal transmitted from the AV apparatus is a signal of a sound volume of sound from the speaker 30, reproduction and stop thereof, and the like. As the AV apparatus, a portable apparatus may be used.

It should be noted that the antenna 626 and the network control circuit 627 may be compliant with the communication standard for constructing WiFi (wireless fidelity), ZigBee, a wireless LAN (local area network), or the like, in addition to Bluetooth.

The power source substrate 50 has a first surface 51 that is opposed to the base 15 side and a second surface 52 that is opposed to the light source unit 40 side. Further, the power source circuit 55 mounted on the power source substrate 50 has one transformer 56T (see FIG. 2) including a primary side coil and a secondary side coil and a primary side electronic component 56 electrically connected to the primary side coil. The transformer 56T and the primary side electronic component 56 are mounted on the first surface 51 of the power source substrate 50.

As described above, the transformer 56T and the primary side electronic component 56 each having a relatively large size are disposed on the base 15 side of the power source substrate 50, thereby making it possible to dispose a component different from the power source circuit 55, for example, a part of the light source unit 40 and the support unit 20 in a space on the front side of the second surface 52. As a result, it is possible to effectively use a small space in the casing 10 (or base casing 12).

(Electrical Structure of Light Source Apparatus)

Figure 7:
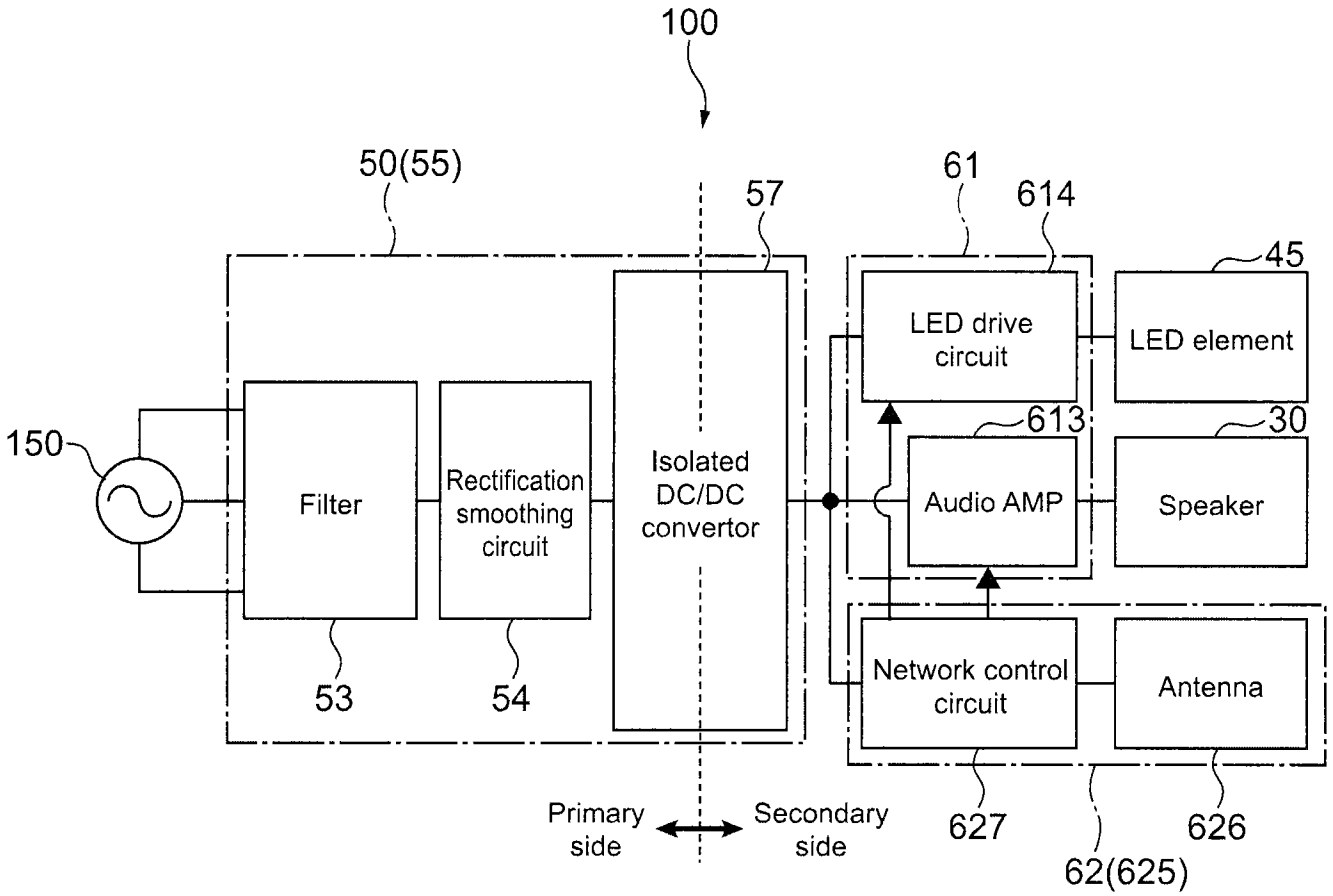
FIG. 7 is a block diagram showing an electrical structure of the light source apparatus.

FIG. 7 is a block diagram showing an electrical structure of the light source apparatus 100.

The light source apparatus 100 is provided with a filter 53, a rectification smoothing circuit 54, an isolated DC/DC converter 57, the LED drive circuit 614, the audio AMP 613, the network control circuit 627, and the antenna 626. A commercial power source 150 supplies power to the power source circuit 55 via the base 15 of the light source apparatus 100.

The filter 53, the rectification smoothing circuit 54, and the isolated DC/DC converter 57 are the power source circuits 55 and are mounted on the power source substrate 50 as described above. The isolated DC/DC converter 57 includes the transformer 56T. For the power source circuit 55, the isolated DC/DC converter 57 is used to electrically insulate the primary side circuit and the secondary side circuit from each other.

The LED drive circuit 614 and the audio AMP 613 are mounted on the drive substrate 61 as described above. The LED drive circuit 614 performs control for turning-on and -off, dimming, and toning of the light source unit 40, and the like. The audio AMP 613 is the drive circuit of the speaker 30 and controls a sound volume of sound from the speaker 30, reproduction and stop thereof, and the like.

As described above, the network control circuit 627 and the antenna 626 are a part of a control circuit 625 and are mounted on the control substrate 62. The network control circuit 627 outputs, to the LED drive circuit 614 and the audio AMP 613, a control signal based on a signal received via the receiving unit 628 and the antenna 626.

For example, a voltage supplied from the commercial power source 150 is 100 to 300 V. The isolated DC/DC converter 57 converts the voltage to a DC power source voltage (first DC power source voltage) of 10 to 30 V, typically 12V and outputs the voltage.

For example, the LED drive circuit 614 is a constant current circuit, which drives the light source unit 40 with electric power of a voltage (second voltage) higher than the DC power source voltage output from the isolated DC/DC converter 57. The second voltage is approximately 40 to 50 V, for example.

The audio AMP 613 drives the speaker 30 with the use of the DC power source voltage output from the isolated DC/DC converter 57.

The network control circuit 627 steps down the voltage of 12V to generate a voltage of approximately 3 to 5 V and operates with electric power of the voltage (third DC voltage). In this case, the control circuit 625 includes a voltage conversion circuit. As the voltage conversion circuit, a switching regulator that constitutes a step-down circuit, for example. Alternatively, the voltage conversion circuit may be provided between the isolated DC/DC converter 57 and the control circuit 625 as a separate block.

As described above, the power source circuit 55 outputs the DC power source voltage generated by the one isolated DC/DC converter 57, that is, the one trans 56T, and the LED drive circuit 614 and the network control circuit 627 are driven with the voltage different from the DC power source voltage. Therefore, it is not necessary to provide a plurality of transformers, which can downsize the power source circuit 55 and the power source substrate 50. As a result, it is possible to achieve the downsizing of the light source apparatus 100.

A difference between the voltage of the LED drive circuit 614 and the voltage of the network control circuit 627 is large, so if the voltages of those circuits are generated by an operation of only stepping up or stepping down, a step-up ratio or a step-down ratio becomes worse, resulting in an increase in power loss of the circuits. In contrast, the isolated DC/DC converter 57 according to this embodiment generates the voltage (10 to 30 V) of an intermediate level of those. Further, the LED drive circuit 614 is driven at a voltage higher than the DC power source voltage, and the network control circuit 627 is driven with a voltage lower than the DC power source voltage, thereby making it possible to suppress the power loss as described above.

(Structure of Ground Connection of Electric Circuit)

As shown in FIG. 2, on the first surface 51 of the power source substrate 50, a secondary side ground connection pattern 59 is formed. The ground connection pattern 59 is conducted with the heat sink 23 and the base casing 12 via the screw S1. That is, the heat sink 23 and the base casing 12 serve as electrical grounds for the power source circuit 55.

As described above, in this embodiment, the insulated power source circuit is used, and the secondary side circuit thereof is grounded. Therefore, it is possible to obtain an appropriate EMS (electromagnetic susceptibility) without generating an EMI (electromagnetic interference) or the like, with the result that the condition of an EMC (electromagnetic compatibility) can be satisfied. In other words, according to the present technology, it is possible to suppress the leakage of high frequency noises from the drive substrate 61 or the like and suppress the leakage of radiation noises from the speaker 30. Further, it is of course possible to suppress exogenous noises from entering the base casing 12.

Further, in this embodiment, members that form a ground potential are the heat sink 23 and the base casing 12 that function as the heat radiation members. That is, the heat sink 23 and the base casing 12 are each equipped with the functions of the ground potential formation and the heat radiation, and therefore it is unnecessary to provide an additional ground member, which contributes to the downsizing of the light source apparatus 100.

By carrying out the EMC countermeasure as described above with respect to the light source apparatus 100, it is possible to apply the light source apparatus 100 to a so-called smart house.

Other Embodiments

The present disclosure is not limited to the above embodiment, and various other embodiments can be implemented.

In the above embodiment, the light source unit 40 on which the LED element 45 that has the point light emission function is mounted is used as an example. The light source unit is not limited to this and may be, for example, an organic or inorganic EL (electro luminescence) element, that is, a light source unit having a surface light emission function, or a fluorescent lamp such as a CCFL (cold cathode fluorescent lighting (lamp)) having a three dimensional light emission function.

Further, the light source unit 40 has the ring shape but may have a polygonal shape having three or more sides or a linear shape (one or more linearly formed shapes). The power source substrate 50 may also have another shape in the same meanings.

In the above embodiment, the damperless speaker is used as an example of the speaker 30, but a general type speaker 30 with no magnetic fluid 38 may be used.

The void area 50*a* of the power source substrate 50 may be formed of a cutout instead of the through hole. Alternatively, the void area 50*a* may be formed with both the through hole and the cutout. In this case, the power source substrate 50 is formed into a C-letter shape. Alternatively, the power source substrate 50 may be formed into a half-ring shape.

In the above embodiment, on one drive substrate 61, the drive circuits of the light source unit 40 and the speaker 30 are mounted, but those may be mounted on separate circuit substrates. Further, in the above embodiment, the drive substrate 61 and the control substrate 62 are provided as different substrates but may be provided as a common substrate.

In addition, in the above embodiment, the power source substrate 50, the drive substrate 61, and the control substrate 62 are provided as different substrates, but the power source substrate 50 and the drive substrate 61 may be provided as a common substrate. Alternatively, the power source substrate 50 and the control substrate 62 may be provided as a common substrate.

In the above embodiment, the receiving unit 628 for the infrared signal is mounted on the control substrate 62 but may be mounted on the drive substrate 61. Alternatively, it is not always necessary to provide the receiving unit 628 for the infrared signal from the remote controller.

Out of the characteristic parts of the embodiments described above, at least two characteristic parts can be combined.

It should be noted that the present disclosure can take the following configurations.

(1) An electric light bulb type light source apparatus, including:

a base;

an insulated power source circuit having a transformer that insulates a primary side circuit and a secondary side circuit from each other and configured to convert a voltage supplied via the base to a first DC power source voltage and output the first DC power source voltage;

a light source unit;

a light source drive circuit configured to drive the light source unit by using the first DC power source voltage output from the power source circuit;

a speaker;

a speaker drive circuit configured to drive the speaker by using the first DC power source voltage output from the power source circuit;

a plurality of substrates on which the power source circuit, the light source drive circuit, and the speaker drive circuit are mounted; and a casing configured to contain the plurality of substrates.

(2) The electric light bulb type light source apparatus according to Item (1), in which the light source drive circuit is a constant current circuit and drives the light source unit with electric power having a second voltage higher than the first DC power source voltage output from the power source circuit.

(3) The electric light bulb type light source apparatus according to Item (1) or (2), further including:

a voltage conversion circuit configured to convert the first DC power source voltage output from the power source circuit and output a third DC power source voltage; and a control circuit configured to receive an external signal transmitted from an external apparatus and output a control signal in accordance with the external signal received to the drive circuits, the control circuit being capable of being driven by using the third DC power source voltage.

(4) The electric light bulb type light source apparatus according to Item (3), in which the first DC power source voltage is higher than the third DC power source voltage.

(5) The electric light bulb type light source apparatus according to Item (3) or (4), in which one of the plurality of substrates is a control substrate on which the control circuit is mounted.

(6) The electric light bulb type light source apparatus according to any one of Items (1) to (5), in which the plurality of substrates include a power source substrate on which the power source circuit is mounted and a drive substrate on which both the light source drive circuit and the speaker drive circuit are mounted, the power source substrate includes a first surface opposed to the base and a second surface provided on a side opposite to the first surface and opposed to the light source unit, the power source circuit has a transformer including a primary side coil and a secondary side coil and a primary side electronic component electrically connected to the primary side coil, and the transformer and the primary side electronic component are mounted on the first surface of the power source substrate.

(7) The electric light bulb type light source apparatus according to any one of Items (1) to (6), in which the light source unit has one of an LED (light emitting diode) and an EL (electro luminescence) element as a light source element.

The present disclosure contains subject matter related to that disclosed in Japanese Priority Patent Application JP 2012-004637 filed in the Japan Patent Office on Jan. 13, 2012, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electric light bulb type light source apparatus, comprising:

a base;

a power source circuit configured to convert a voltage supplied via the base to a first DC power source voltage and output the first DC power source voltage;

a transformer coupled with the power source circuit;

a light source unit that is opposed to the base;

a light source drive circuit configured to drive the light source unit by using the first DC power source voltage output from the power source circuit;

a speaker;

a speaker drive circuit configured to drive the speaker by using the first DC power source voltage output from the power source circuit;

a casing configured to contain a plurality of substrates; and a power source substrate having a first surface facing the base and a second surface facing the light source unit wherein the power source circuit and the transformer both are disposed on the first surface of the power source substrate.

2. The electric light bulb type light source apparatus according to claim 1, wherein the light source drive circuit is a constant current circuit and drives the light source unit with electric power having a second voltage higher than the first DC power source voltage output from the power source circuit.

3. The electric light bulb type light source apparatus according to claim 1, further comprising:

a voltage conversion circuit configured to convert the first DC power source voltage output from the power source circuit and output a third DC power source voltage; and a control circuit configured to receive an external signal transmitted from an external apparatus and output a control signal in accordance with the external signal received to the drive circuits, the control circuit being capable of being driven by using the third DC power source voltage.

4. The electric light bulb type light source apparatus according to claim 3, wherein the first DC power source voltage is higher than the third DC power source voltage.

5. The electric light bulb type light source apparatus according to claim 3, wherein one of the plurality of substrates is a control substrate on which the control circuit is mounted.

6. The electric light bulb type light source apparatus according to claim 1, further comprising:

the plurality of substrates on which the power source circuit, the light source drive circuit, and the speaker drive circuit are mounted, wherein the plurality of substrates include the power source substrate:

a primary side coil and a secondary side coil included in the transformer; and a primary side electronic component electrically connected to the primary side coil, wherein the transformer and the primary side electronic component are mounted on the first surface of the power source substrate.

7. The electric light bulb type light source apparatus according to claim 1, wherein the light source unit has one of an LED (light emitting diode) and an EL (electro luminescence) element as a light source element.

* * * * *